US006695229B1

(12) United States Patent
Heinbuch et al.

(10) Patent No.: US 6,695,229 B1
(45) Date of Patent: Feb. 24, 2004

(54) SWIRL DISK AND FUEL INJECTION VALVE WITH SWIRL DISK

(75) Inventors: Petra Heinbuch, Stuttgart (DE); Frank Schatz, Kornwestheim (DE); Armin Glock, Urbach (DE); Ralf Trutschel, Wolfen (DE); Gottfried Flik, Leonberg (DE); Guenter Dantes, Eberdingen (DE); Detlef Nowak, Untergruppenbach (DE); Joerg Heyse, Besigheim (DE); Thomas Schittny, Fulda (DE); Juergen Hackenberg, Sachsenheim (DE); Ronald Glas, Achern (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/445,529

(22) PCT Filed: Apr. 1, 1999

(86) PCT No.: PCT/DE99/00983

§ 371 (c)(1),
(2), (4) Date: Jul. 27, 2001

(87) PCT Pub. No.: WO99/53195

PCT Pub. Date: Oct. 21, 1999

(30) Foreign Application Priority Data

Apr. 8, 1998 (DE) ..... 198 15 775

(51) Int. Cl.[7] ..... B05B 1/34

(52) U.S. Cl. ..... 239/494; 239/491; 239/533.12; 239/584; 239/596

(58) Field of Search ..... 239/461, 491, 239/494, 533.11, 533.12, 584, 596, 585.1

(56) References Cited

U.S. PATENT DOCUMENTS

| | | | | |
|---|---|---|---|---|
| 1,440,705 A | | 1/1923 | Sumner | |
| 4,040,396 A | | 8/1977 | Tomita | |
| 5,435,884 A | | 7/1995 | Simmons et al. | |
| 5,766,441 A | * | 6/1998 | Arndt et al. | 239/596 |
| 5,899,390 A | * | 5/1999 | Arndt et al. | 239/533.12 |
| 5,924,634 A | * | 7/1999 | Arndt et al. | 239/533.12 |
| 6,050,507 A | * | 4/2000 | Holzgrefe et al. | 239/596 |

FOREIGN PATENT DOCUMENTS

| | | |
|---|---|---|
| DE | 39 43 005 | 7/1990 |
| DE | 196 07 288 | 10/1996 |
| GB | 2 176 839 | 1/1987 |
| WO | 96/11335 | 4/1996 |

* cited by examiner

*Primary Examiner*—Steven J. Ganey
(74) *Attorney, Agent, or Firm*—Kenyon & Kenyon

(57) ABSTRACT

A swirl disk is composed of at least one metallic material, and is configured as having at least one intake area and at least one outlet orifice, the at least one outlet orifice being introduced in a lower base layer, and having at least two swirl channels emptying into a swirl chamber, the swirl chamber being provided in a central swirl-producing layer. An upper layer is configured as a cover layer, which over its entire cross-sectional surface represents a closed layer without orifice contours. All the layers of the swirl disk are directly built up on top of each other using electroplating metal deposition (multilayer electroplating). The swirl disk is suitable for a use in a fuel injection valve, in particular in a high-pressure injection valve for directly injecting the fuel into a combustion chamber of a mixture-compressing, external-ignition internal combustion engine.

54 Claims, 7 Drawing Sheets

SWIRL DISK AND FUEL INJECTION VALVE WITH SWIRL DISK

BACKGROUND INFORMATION

German Patent Application No. 39 43 005 describes an electromagnetically actuatable fuel injection.

From German Patent 39 43 005 an electromagnetically actuatable fuel injection valve, in which a plurality of disk-shaped elements is arranged in the area of the seat. When the magnetic circuit is excited, a planar valve plate acting as a planar armature is lifted off a valve seat plate, situated opposite and cooperating with it, which together form a plate valve part. Upstream of the valve seat plate, a swirl element is arranged that sets the fuel flowing to the valve seat in a circular swirling motion. A stop plate sets a limit to the axial path of the valve plate on the side opposite the valve seat plate. The valve plate is surrounded by the swirl element such that it has a lot of play; the swirl element thus takes on a certain guiding function of the valve plate. In the swirl element a plurality of tangentially running grooves is introduced on its lower end face, the grooves extending from the external periphery to a central swirl chamber. If the swirl element is placed with its lower end face on the valve seat plate, the grooves function as swirl channels.

International Publication No. WO 96/11335 describes a fuel injection valve at whose downstream end a multi-disk atomizing attachment having a swirl-generating device is arranged. This atomizing attachment is provided on a valve seat support (member) downstream of a disk-shaped guide element installed in the valve seat support and of a valve seat also on the valve seat support, the atomizing attachment being held in a defined position by an additional supporting element. The atomizing attachment is executed so as to have two or four disks, the individual disks being made of stainless-steel or silicon. Correspondingly, in manufacturing the orifice geometries in the disks, conventional processing methods are used such as eroding, stamping, or etching. Each individual disk of the atomizing attachment is manufactured separately, in accordance with which, depending on the desired number of disks, all disks of the same size are stacked up one on the other to produce the complete atomizing attachment.

German Patent Application No. 196 07 288 describes so-called multilayer electroplating in detail for the manufacture of perforated disks that are suitable for use in fuel injection valves. This manufacturing principle of disk production, as described in German Patent Application No. 196 07 288 involving the multiple electroplating metal deposition of various structures on top of each other so that one-piece disk results, is expressly incorporated herein by reference. Micro-electroplating metal deposition in a plurality of planes, levels, or layers is also used in the manufacture of swirl disks according to the invention.

SUMMARY OF THE INVENTION

A swirl disk of the present invention has the characterizing features of claim 1 has the advantage that it can be manufactured in a particularly simple manner so as to be cost-effective. A particular advantage lies in the fact that the swirl disks can be manufactured extremely precisely in very large batches at one time (high batch capacity). Due to their metal construction, swirl disks of this type are very break resistant and easy to install, for example in injection valves or other spray-discharge nozzles for liquids of all types. The use of multilayer electroplating permits extremely great freedom of design, since the contours of the orifice areas (intake areas, swirl channels, swirl chamber, outlet orifice) in the swirl disk can be freely selected. Particularly in comparison with silicon disks, in which the achievable contours are rigidly prescribed on the basis of the crystal axes (pyramid stubs), this design flexibility is very advantageous.

In comparison to the production of silicon disks, metal deposition has the advantage of a very large variety of materials. The most various metals having their varying magnetic properties and hardnesses can be used in the micro-electroplating process employed in manufacturing the swirl disks. The varying hardnesses of the various metals can be used in a particularly advantageous manner, in that a material area is created having sealing properties.

The great technical freedom of design of the contours within the swirl disk in turn results in the great advantage that various stream shapes of the spray to be discharged can be generated in a simple manner. Thus it is possible to obtain stream profiles and sprays in the form of hollow cones, slanted hollow cones, solid cones, slanted solid cones, cones having skeins, or planar streams, which are all advantageously generated by the swirl-generating effects in the swirl disk. Using multilayer electroplating, it is possible to obtain extremely high-precision undercuts and overlaps in a particularly advantageous manner, cost effectively and without difficulty.

It is particularly advantageous to construct the swirl disk having three layers by carrying out three electroplating steps for the metal deposition. In this context, the upstream layer represents a cover layer, which completely covers the swirl chamber of a central swirl-producing layer. The swirl-producing layer is formed by one or more material areas, which due to their contouring and their geometrical position with respect to each other indicate the contours of the swirl chamber and of the swirl channels. As a result of the electroplating process, the individual layers are designed without separating or joining points so that they represent an uninterruptedly homogeneous material. To this extent, "layers" should be understood as a conceptual aid.

In an advantageous manner, provision is made in the swirl disk for two, three, four, or six swirl channels. The material areas, in accordance with the desired conturing of the swirl channels, can have very different shapes, e.g., bar-shaped or spiral-shaped. In an advantageous manner, the contours of the swirl chamber, the cover layer, and the outlet orifice can be designed in a flexible manner, it being possible through the asymmetries of certain orifice contours to generate particularly suitable, e.g., engine-specific stream images and spray shapes. The production of sprays or streams inclined with respect to the axis of symmetry of the swirl disk at an angle $\gamma$ (hollow or solid cones, a large or small skein component over the periphery, equal or unequal distribution over the periphery, non-rotationally symmetrical (planar-) stream shapes having adjustable skein components) in a simple manner and without additional components having prescribed diagonal spray-discharge contours (diagonal holes) represents an extraordinarily important advantage of the swirl disks of the present invention.

In a particularly advantageous manner, the swirl disk is executed such that the material areas are shaped so as to diverge from each other such that all the swirl channels have a different orientation with respect to the symmetrical axis of the swirl disk. Seen from around the periphery of the swirl disk, the swirl channels run such that their radial orientations and their tangential swirl orientations are continually changing in the reverse direction (when viewed from one swirl channel to another swirl channel). In a simple manner, a shaping of this type makes it possible to spray-discharge a swirl-impacted rotationally-symmetrical hollow-cone spray having equal distribution across the hollow-cone periphery. Sprays that are tilted with respect to the axis of symmetry and have the above-mentioned properties can be produced without downstream precision-manufactured components.

The fuel injection valve of the present invention has the advantage that it makes it possible to achieve a very high atomization quality of a fuel to be spray-discharged, as well as a stream or spray shape, that reflects the given requirements (e.g., installation conditions, engine configurations, cylinder shapes, spark plug positions). As a consequence, through the use of multilayer-electroplated swirl disks in an injection valve of an internal combustion engine, inter alia, the exhaust gas emissions of the internal combustion engine can be reduced, and similarly fuel consumption can be reduced.

From the advantages indicated above with regard to the swirl disks, corresponding advantages for the use in a fuel injection valve can also be deduced, because, as a result of the simplified and easy-to-reproduce mode of production of the swirl disks, coupled with the high functionality of the swirl generation in the liquid, there are for the fuel injection valve precisely the same advantages of high quality, equal and fine atomization, high variability in stream shapes, and cost effectiveness.

In operating an engine, the problem generally arises in the direct injection of gasoline that the downstream tip of the injection valve extending into the combustion chamber is coked by gasoline deposits. In the conventional injection valves extending into the combustion chamber, the danger therefore exists, through their service life, of a negative influence on the spray parameters (e.g., static flow quantities, stream angles), that can lead to a failure of the injection valve. By using a multilayer-electroplated swirl disk made of the materials nickel or nickel-cobalt and situated at the downstream end of the fuel injection valve, the coking in this area is effectively prevented. Other suitable materials are cobalt- and nickel-oxide and oxides of alloys of the aforementioned metals. By constructing the swirl disk out of materials of this type, a complete combustion of soot particles is catalyzed, and the deposition of carbon particles is prevented. Catalytic effectiveness is also shown by the rare metals, Ru, Rh, Pd, Os, Ir, and Pt, and by alloys of these metals, with each other or with other metals.

Further advantages are listed in greater detail in the following description of the exemplary embodiments.

Figure 1:
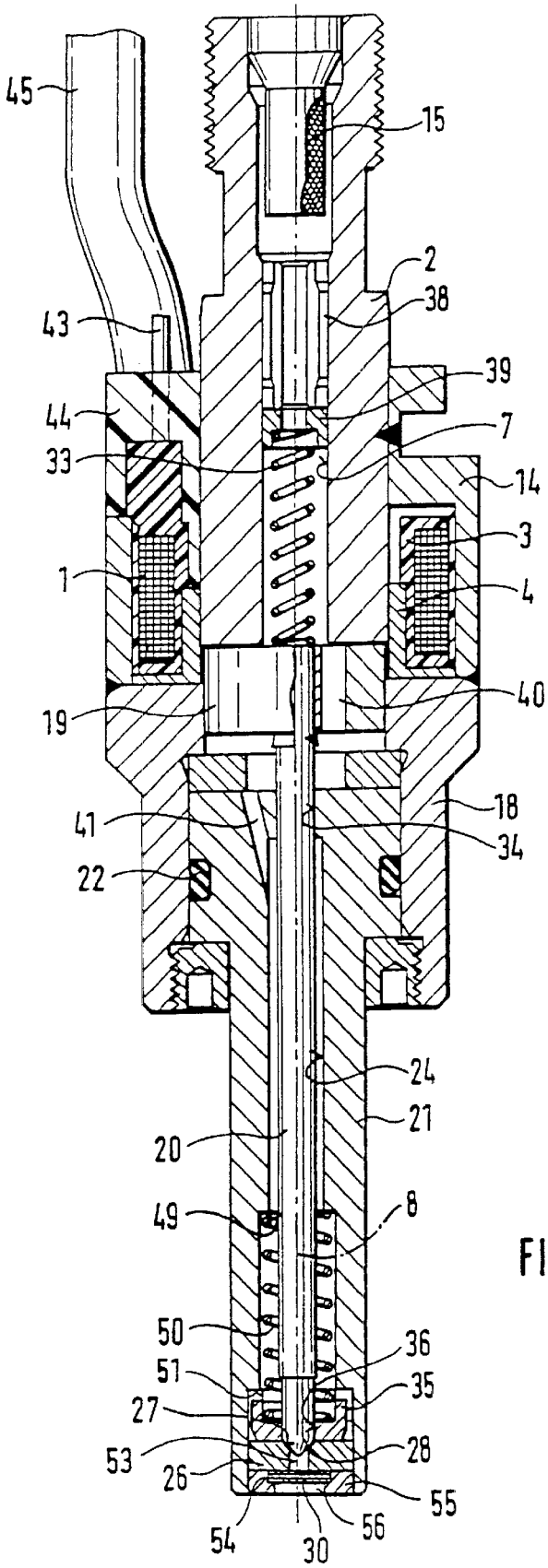
FIG. 1 shows a cross-section view of a fuel injection valve which can include a swirl disk.

The electromagnetically actuatable valve depicted in FIG. 1 by way of example, in the form of an injection valve for fuel injection systems of mixture-compressing, external-ignition internal combustion engines, has a tube-shaped, essentially hollow cylindrical core 2, functioning as the internal pole of a magnetic circuit at least partially surrounded by a solenoid coil 1. The fuel injection valve is particularly suitable as a high-pressure injection valve for directly injecting fuel into a combustion chamber of an internal combustion engine. For the use of the swirl disks of the invention, to be described in detail below, an injection valve (for gasoline or diesel use, for direct- or intake-type injection) represents only one important area of application. These swirl disks can also be used in ink jet printers, in nozzles for disbursing liquids of all types, or in inhalers. For generating fine sprays having swirl components, the swirl disks of the present invention are suitable quite generally.

A coil shell 3, which can be designed, for example, as stepped, and which is made of plastic, receives a winding of solenoid coil 1 and makes possible a particularly compact and short design of the injection valve in the area of solenoid coil 1, in connection with core 2 and with an annular, non-magnetic intermediate part 4, partially surrounded by solenoid coil 1, the intermediate part having an L-shaped cross-section.

In core 2, provision is made for a connecting longitudinal orifice 7, which extends along a valve longitudinal axis 8. Core 2 of the magnetic circuit also functions as a fuel intake connecting pipe, longitudinal orifice 7 representing a fuel supply duct. Fixedly joined to core 2 above solenoid coil 1 is an external metallic (e.g., ferrite) housing part 14, which, as the external pole or external connecting element, closes the magnetic circuit and completely surrounds solenoid coil 1 at least in the peripheral direction. In longitudinal orifice 7 of core 2, provision is made on the supply side for a fuel filter 15, which acts to filter out those fuel components which could cause blockages or damage in the injection valve on account of their size. Fuel filter 15 is fixed in core 2, e.g., by a pressing-in process.

Core 2 along with housing part 14 constitutes the supply-side end of the fuel injection valve, upper housing part 14, for example, extending beyond solenoid coil 1 in the axial direction, from a downstream point of view. A lower tube-shaped housing part 18 is joined to upper housing part 14 in a sealing and fixed manner, lower tube-shaped housing part surrounding and receiving, for example, an axially movable valve part composed of an armature 19 and a bar-shaped valve needle 20 or an elongated valve seat support 21. The movable valve part, however, could also have the form, e.g., of a planar disk having an integrated armature. Both housing parts 14 and 18 are fixedly joined to each other, e.g., by a circumferential welded seam.

In the exemplary embodiment depicted in FIG. 1, lower housing part 18 and essentially tube-shaped valve seat support 21 are fixedly joined to each other using bolts; but welding, soldering, or flanging also represent possible joining methods. The seal between housing part 18 and valve seat support 21 is effected, e.g., using a sealing ring 22. Valve seat support 21 has an inner through-orifice 24 over its entire axial extension, running concentrically with regard to valve longitudinal axis 8. Valve seat support 21, at its lower end 25, which also represents the downstream end of the entire fuel injection valve, surrounds a disk-shaped valve seat element 26, fitting tightly in through-orifice 24 and having a valve seat surface 27 tapering in the downstream direction in a truncated-cone shape. In through-orifice 24 is arranged valve needle 20 having, e.g., a substantially circular cross section and a rod-like shape, the valve needle at its downstream end having a valve-closure segment 28. This valve closure segment 28, e.g., tapering into a cone, cooperates in a known manner with valve seat surface 27 provided in valve seat element 26. Downstream of valve seat surface 27, following valve seat element 26, is a swirl disk 30 according to the invention, which is manufactured using multilayer electroplating and which includes three metallic layers deposited one on the other.

The actuation of the injection valve occurs in a known manner electromagnetically. Functioning to bring about the axial movement of valve needle 20, and thus for opening the resetting spring 33 arranged in longitudinal orifice 7 of core 2 in opposition to the spring force, or for closing the injection valve, is the electromagnetic circuit having solenoid coil 1, core 2, housing parts 14 and 18, and armature 19. Armature 19 is joined to the end of valve needle 20 that is facing away from valve closure segment 28, e.g., by a welded seam, and it is aligned with core 2. For guiding valve needle 20 during its axial movement together with armature 19 along valve longitudinal axis 8, there are provided, on the one hand, a guide orifice 34 provided in valve seat support 21 on the end facing armature 19, and, on the other hand, a disk-shaped guide element 35 having a guide orifice 36 that is accurate to size. Armature 19 during its axial movement is surrounded by intermediate part 4.

In place of the electromagnetic circuit, a different excitable actuator can be used, such as a piezo stack, in a comparable fuel injection valve, or the actuation of the axially movable valve part can take place using hydraulic pressure or servo (power) pressure.

An adjusting sleeve 38 that is inserted pressed, or screwed into longitudinal orifice 7 of core 2 functions to adjust the prestressing resilience of resetting spring 33, its upstream end contacting adjusting sleeve 38 via a centering piece 39, resetting spring 33 being supported at its opposite end on armature 19. Provision is made in armature 19 for one or more flow channels 40, similar to bore holes, through which the fuel can proceed from longitudinal orifice 7 in core 2 via connecting channels 41, configured downstream of flow channels 40 and in the vicinity of guide orifice 34 in valve seat support 21, and arrive in through-orifice 24.

The stroke of valve needle 20 is predetermined by the fitting position of valve seat element 26. An end position of valve needle 20, in the non-excited state of solenoid coil 1, is established by the position of valve-closure segment 28 on valve seat surface 27 of valve seat element 26, whereas the other end position of valve needle 20, in the excited state of solenoid coil 1, results from the position of armature 19 at the downstream end face of core 2. The surfaces of the components in the aforementioned limit-stop area are chromium-plated, for example.

The electrical contacting of solenoid coil 1, and thus its excitation, occurs via contact element 43, which is furnished with a plastic extrusion coat 44 located outside coil shell 3. Plastic extrusion coat 44 can also extend to other components (e.g., housing parts 14 and 18) of the fuel injection valve. Emerging from plastic extrusion coat 44 is an electrical connecting cable 45, through which solenoid coil 1 receives power. Plastic extrusion coat 44 extends through upper housing part 14, which is interrupted in this area.

Downstream of guide orifice 34, through-orifice 24 of valve seat support 21 is designed, for example, as having two steps. The first step 49 functions as a stop surface for a pressure spring 50 that is, e.g., screw-shaped. Second step 51 creates an enlarged installation space for three disk-shaped elements 35, 26, and 30. Pressure spring 50 surrounding valve needle 20 distorts (or twist) guide element 35 in valve seat support 21, since it presses against guide element 35 with its end opposite step 49. Downstream of valve seat surface 27, in valve seat element 26, an outlet orifice 53 is introduced, through which, when the valve is open at valve seat surface 27, the fuel flows, subsequently entering into swirl disk 30. Swirl disk 30 is located, e.g., in a recess 54 of a disk-shaped retaining element 55, retaining element 55 being fixedly joined to valve seat support 21, e.g., using welding, adhesive, or compression-type jamming. The mounting variant of swirl disk 30 indicated in FIG. 1 is depicted only in simplified form and only depicts one of many various possibilities of mounting. Of decisive importance is the arrangement in principle of swirl disk 30, deposited using micro-electroplating, downstream of valve seat surface 27. In retaining element 55 downstream of recess 54 facing the valve seat, there is configured a central outlet orifice 56, through which the now swirl-impacted fuel leaves the fuel injection valve.

Figure 2:
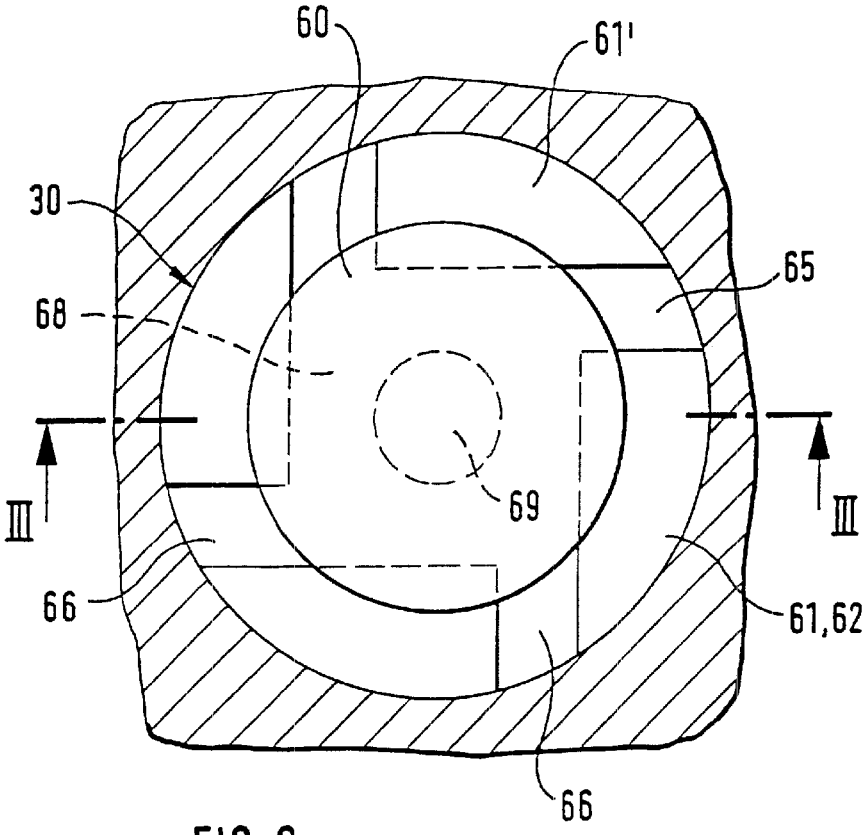
FIG. 2 shows a top view of the swirl disk according to the present invention.
Figure 3:
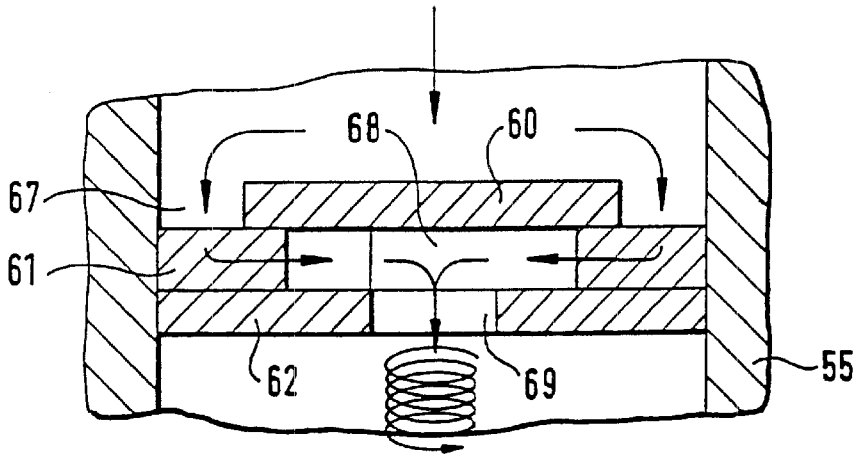
FIG. 3 shows a cross-sectional view of the swirl disk taken along line III—III illustrated in FIG. 2.

FIG. 2 depicts a basic representation of a swirl disk 30 according to the present invention, whereas FIG. 3 shows a cross-section along line III—III illustrated in FIG. 2. In this context, in FIG. 2 a top view of swirl disk 30 is depicted, in which all layers of swirl disk 30 are made clear, based on a "glass-like" manner of presentation. The layered construction is indicated particularly clearly in the axial direction in FIG. 3, which is ultimately an enlarged representation of the swirl disk area from FIG. 1. In FIG. 3 various cross-hatchings were selected for the individual deposited layers, although it should be expressly emphasized that swirl disks 30 are one-piece components, since the individual layers are deposited directly on each other, rather than being joined subsequently. The layers of swirl disk 30 are deposited using electroplating one after the other, so that the subsequent layer fixedly binds to the layer below, due to electroplating adhesion.

Swirl disk 30 has an external diameter such that it can fit tightly, with little play, into a receiving orifice on the fuel injection valve, e.g., into recess 54 of retaining element 55 or into an orifice of valve seat support 21. Swirl disk 30 is formed out of three surfaces, planes, or layers, that are deposited one on the other using electroplating, which therefore, in the integral state, follow each other axially. In the following, the three layers of swirl disk 30 are designated according to their function as cover layer 60, swirl-producing layer 61, and base layer 62. As can be seen from FIGS. 2 and 3, upper cover layer 60 is configured as having a smaller external diameter than the two succeeding layers 61, 62. In this manner, it is assured that the fuel at cover layer 60 can flow past on the outside and thus can enter without difficulty into external intake areas 65 of, for example, four swirl channels 66 exiting from the outer periphery of swirl disk 30 in central swirl-producing layer 61 (see the arrows for the flow course in FIG. 3). Swirl disks 30 can be manufactured according to the present invention as having more than three layers, the structure of layers 60, 61, 62, described above, also being visible in these cases in a comparable manner, but having, e.g., another, fourth (not depicted) structural layer growing up on cover layer 60, the structural layer potentially being expedient for certain installation conditions and for reasons of incident flow.

Upper cover layer 60 represents a closed metallic layer, which does not have any orifice areas for through flow, but which, due to its smaller diameter is surrounded by an annular flow area 67. In swirl-producing layer 61, on the other hand, provision is made for a complex orifice contour, running over the entire axial thickness of this layer 61. The orifice contour of central layer 61 is formed by an inner swirl chamber 68 as well as by a multiplicity of swirl channels 66 emptying into swirl chamber 68. As shown in FIG. 2 of swirl disk 30, central layer 61 has a substantially square swirl chamber 68 as well as four swirl channels 66. Swirl channels 66, e.g., in each case running perpendicular to adjoining swirl channels 66, empty tangentially into swirl chamber 68. Whereas swirl chamber 68 is completely covered by cover layer 60, swirl channels 66 are only partially covered, since the external ends facing swirl chamber 68 form the intake areas 65 that are open in the upwards direction. As a result of the tangential flow of swirl channels 66 into swirl chamber 68, the fuel is given an angular momentum, which is retained also in a central circular outlet orifice 69 in lower base layer 62. The diameter of outlet orifice 69 is, e.g., markedly smaller than the orifice width of swirl chamber 68 located directly above it. In this manner, the swirl intensity generated in swirl chamber 68 is increased. As a result of centrifugal force, the fuel is spray-discharged in the form of a hollow cone.

Swirl disks 30 according to the present invention are built up in a multiplicity of metallic layers using electroplating deposition (multilayer electroplating). Due to the manufacturing using deep-lithographic, electroplating-technical processes, there are particular features in the conturing, of which several are listed here in summary form:

- layers having a thickness that is constant over the surface of the disk,
- as a result of the deep-lithographic structuring, essentially vertical indentations in the layers, which form the hollow chambers that in each case receive the flow (deviations of approximately 3° with regard to the optimally vertical walls can arise for manufacturing technical reasons).
- desirable undercuts and overlaps of the indentations as a result of the multilayer build-up of metallic layers that are individually structured,
- indentations (incisions notches) having any type of cross-sectional shapes having walls that are essentially parallel with respect to the axis,
- one-piece execution of the swirl disk, since the individual metal depositions directly follow each other.

Below, the method for manufacturing swirl disks 30 is elaborated only in abbreviated form. All of the method steps of the electroplating metal deposition for manufacturing a perforated disk are described in detail in German Patent Application No. 196 07 288. It is characteristic for the method of successive application of photo-lithographic steps (UV deep-lithography) and subsequently of micro-electroplating, that even in large-surface dimensions, a high precision of the structures is assured, so that it is ideal for use in mass production for very large quantities (high batch capability). On a panel or wafer, a multiplicity of swirl disks 30 can be manufactured at the same time.

The method according to the present invention provides a level and stable support plate, which can be made, e.g., of metal (titanium, steel), silicon, glass, or ceramics. On the supporting plate, first at least one auxiliary layer is optionally deposited. In this context, e.g., an electroplating starting layer (e.g., TiCuTi, CrCuCr, Ni), which is necessary for the electrical supply line for the subsequent micro-electroplating. The deposition of the auxiliary layer takes place, e.g., by sputtering or by currentless metal deposition. After this pre-treatment of the supporting plate, a photo resist (photo-sensitive resist) is deposited over the entire surface onto the auxilliary layer, e.g., using rolling or spin-on deposition.

The thickness of the photo resist, in this context, should correspond to the thickness of the metallic layer which is to be realized in the subsequent electroplating process, i.e., to the thickness of lower base layer 62 of swirl disk 30. The resist layer can be composed of one or more layers of a film that can be photo-structured or of a liquid resist (polyimide, photo-sensitive resist). If a sacrificial layer should optionally be electroplated in the resist structures generated later, the thickness of the photo resist should be increased by the thickness of the sacrificial layer. The metallic structure to be realized should be applied inversely in the photo resist with the assistance of a photo-lithographic mask. One possibility consists in exposing (UV deep-lithography) the photo resist directly through the mask using UV irradiation (circuit board irradiator or semiconductor irradiator) and subsequently developing it.

The structure that arises ultimately in the photo resist and that is negative with respect to the subsequent layer 62 of swirl disk 30 is filled up with metal through electroplating (e.g., Ni, NiCo, NiFe, NiW, Cu). Due to the electroplating, the metal contacts closely the contour of the negative structure, so that the prescribed contours are reproduced in it so as to be true to the shape. To realize the structure of swirl disk 30, the steps must be repeated beginning with the optional deposition of the auxilliary layer in accordance with the number of layers desired, so that, in a three-layer swirl disk 30, three electroplating steps are undertaken. For the layers of a swirl disk 30, various metals can also be used which, however, can be employed only in a further electroplating step.

In the manufacture of cover layer 60 of swirl disk 30, metal is deposited both on the conductive material areas 61' as well as on the non-conductive photo resist in the area of swirl channels 66 and swirl chamber 68. For this purpose, a starting layer metallization is deposited on the resist of preceding central layer 61. After the deposition of upper cover layer 60, the remaining photo resist is dissolved from the metal structures using a wet-chemical stripping. In the case of smooth, passivized support plates (substrates), swirl disks 30 can be detached from the substrate and separated. In support plates of swirl disks 30 having good adhesion, the sacrificial layer is selectively etched away to the substrate and swirl disk 30, as a result of which swirl disks 30 can be lifted off from the support plate and separated.

FIGS. 4 through 12 show nine exemplary embodiments of multilayer-electroplated swirl disks 30, which emphasize the orifice contours shown in FIG. 2. These various specific embodiments, in accordance with the desired application, can function to generate conventional, rotationally symmetrical spray-discharge cones, but also flat-stream images or tilted asymmetrical stream images.

Figure 4:
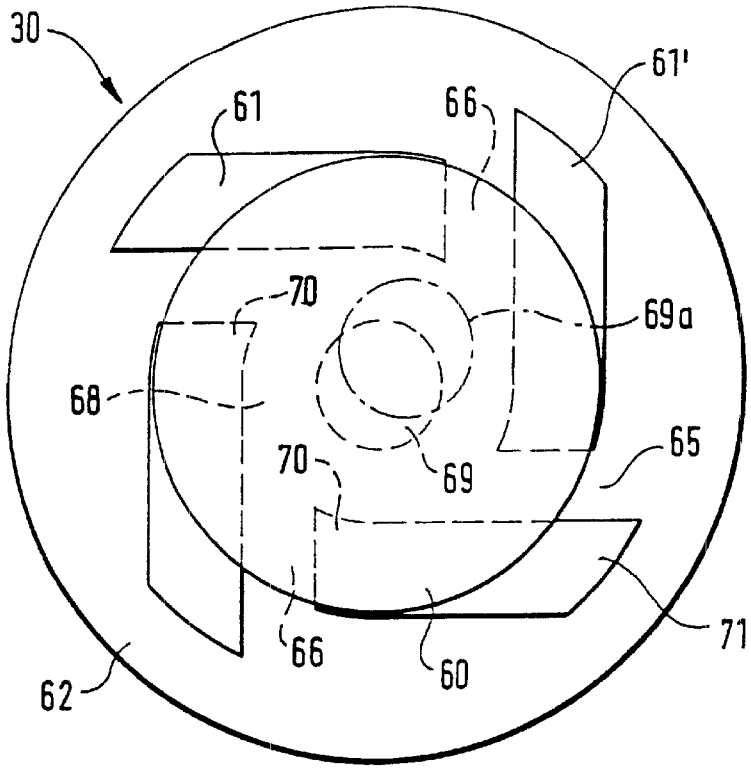
FIG. 4 shows a top view of a first exemplary embodiment of a multilayer electroplated swirl disk.

In FIG. 4, a swirl disk 30 is depicted which in turn has three layers 60, 61, and 62. In this context, upper cover layer 60 and lower base layer 62 are shaped in a way that is comparable to FIG. 2, i.e., having a circular contour, base layer 62 having a larger external diameter and a central outlet orifice 69. Central swirl-producing layer 61, differs, from that depicted in FIG. 2. Whereas, in the exemplary embodiment shown in FIG. 2, the four material areas 61' set at a distance from each other in the peripheral direction, between which the contours of swirl channel 65 and swirl chamber 68 are precisely delineated, start from the external edge of swirl disk 30, material areas 61' of swirl-producing layer 61 according to FIG. 4 are in each case bar-like and are configured with clearance from the external edge of swirl disk 30. Four material areas 61' are essentially perpendicular to respective adjoining material areas 61' and form, at a defined distance from each other, swirl channels 66 covered by cover layer 60. Ends 70 of material areas 61', radially bordering on swirl chamber 68, are rounded off, e.g., with a shovel shape, so that the contour of material areas 61' itself functions for producing a swirl of the fuel to be spray-discharged and a circular swirl chamber 68 is formed. Ends 71 of material areas 61', located opposite interior ends 70, are also rounded off, e.g., at their external contour, as a result of which a joining diameter is predetermined, on the basis of which swirl disk 30 in a simple manner can be inserted and mounted, e.g., in an orifice of a fuel injection valve.

For producing an asymmetrical stream image having an angle y with respect to the axis of symmetry of swirl disk 30, or with respect to valve longitudinal axis 8 of the valve, outlet orifice 69 can also be introduced off-center in base layer 62, as outlet orifice 69*a* indicates in FIG. 4 in a dot-dash line. In addition to a diagonal orientation, a specific embodiment of this type can also bring about a possibly desirable unequal distribution over the periphery of the hollow or solid cone, so that there is an asymmetry in several respects.

Figure 5:
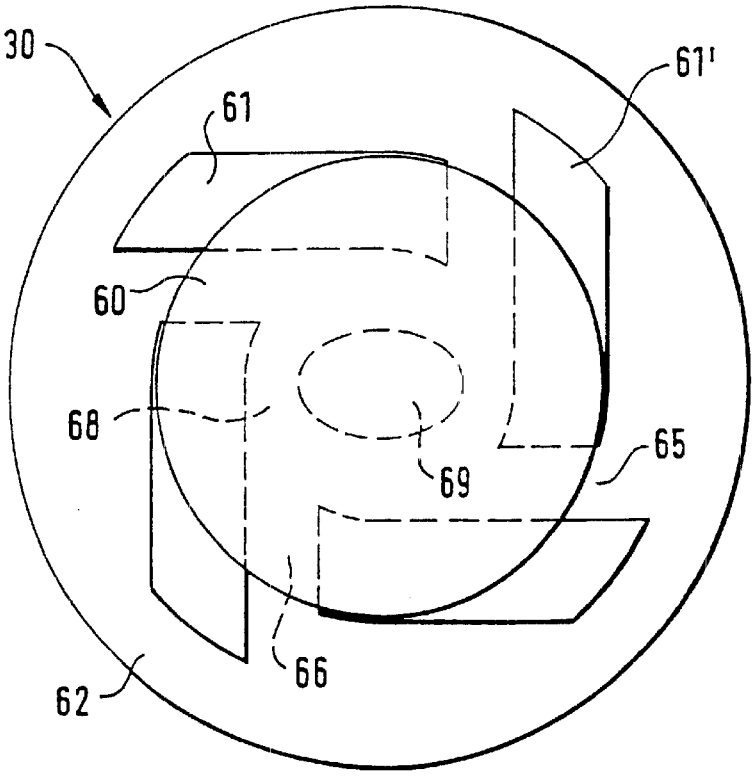
FIG. 5 shows a top view of a second exemplary embodiment of the multilayer electroplated swirl disk.
Figure 6:
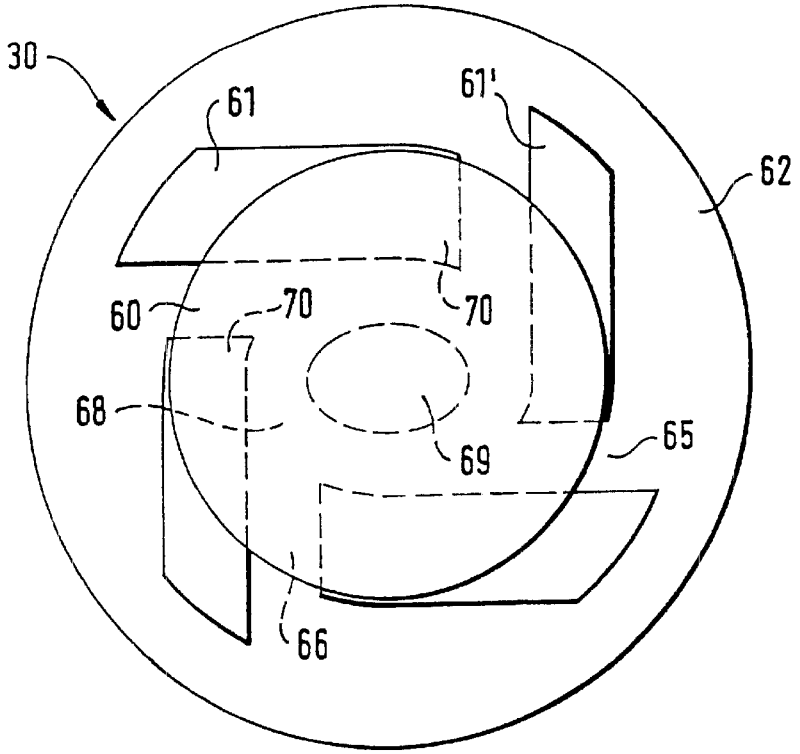
FIG. 6 shows a top view of a third exemplary embodiment of the multilayer electroplated swirl disk.

In FIGS. 5 and 6, swirl disks 30 are depicted which have elliptical outlet orifices 69 in base layer 62. A swirl disk 30 configured in this manner can produce swirl-impacted planar stream images. Swirl disk 30 according to FIG. 5 has a rotationally symmetrical swirl chamber 68; swirl disk 30 according to FIG. 6, on the other hand, has an elliptical swirl chamber 68, that is adjusted to the contour of outlet orifice 69 and provides for a particularly uniform flow. An elliptical swirl chamber 68, as shown in FIG. 6, can be produced by configuring two material areas 61' located opposite each other so that they have the same width, but a different width with respect to the other two material areas 61', specifically so that all ends 70 of material areas 61' have the same distance to elliptical outlet orifice 69.

Figure 7:
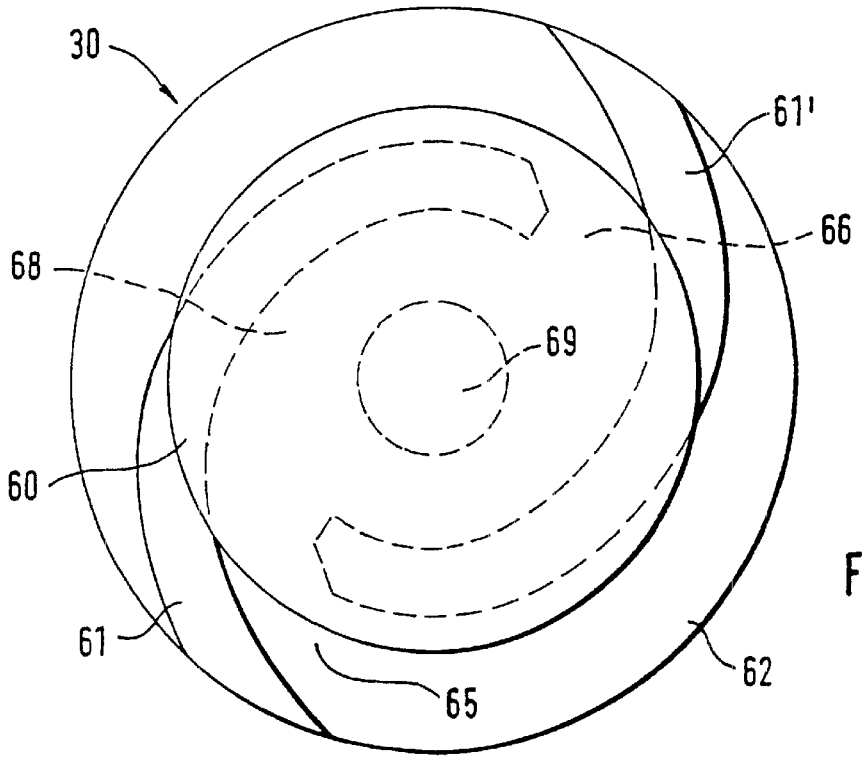
FIG. 7 shows a top view of a fourth exemplary embodiment of the multilayer electroplated swirl disk.
Figure 8:
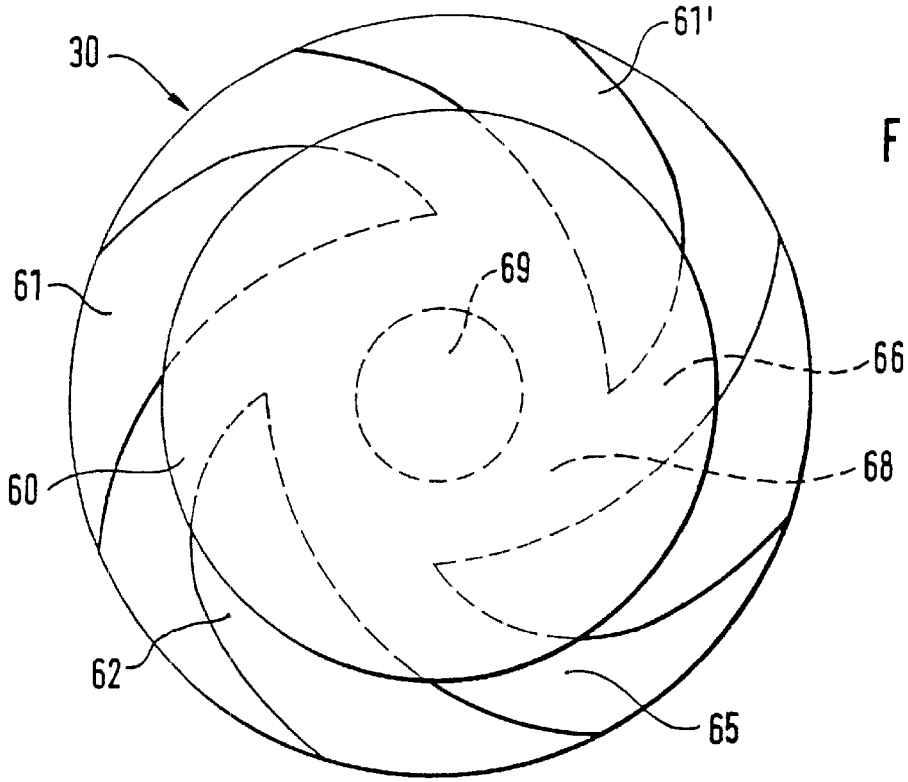
FIG. 8 shows a top view of a fifth exemplary embodiment of the multilayer electroplated swirl disk.

Swirl disks 30 having spiral-shaped material areas 61' of swirl-producing layer 61 are illustrated in FIGS. 7 and 8. In place of bar-like material areas 61', at a distance from the edge of swirl disk 30, as in the preceding exemplary embodiments, the two (FIG. 7) or four (FIG. 8) material areas 61' are rotated yielding a spiral shape, proceeding from the external edge. In this context, swirl channels 66, particularly in the example depicted in FIG. 8, have a narrowing of the cross-section in the direction of flow in order to reduce flow losses, since the narrowest point is limited to a short running length. At the same time, a configuration of this type produces a less turbulent flow and thus a smaller flow resistance. The geometry of the spray-discharged cone formed downstream of outlet orifice 69 is determined by the swirl speed of the liquid. Higher swirl speeds yield spray-discharged cones having greater spray angles. Swirl speeds can also be adjusted by the ratio between the diameters of swirl chamber 68 and outlet orifice 69 as well as by the swirl channel cross-section.

As described above, it is desirable in various application areas of perforated disks generally and in swirl disks in particular to produce tilted stream images having an angle $\gamma$ with respect to the longitudinal axis. For the direct injection of gasoline, for example, on the basis of given installation conditions in the combustion chamber, injection valves are advantageous which discharge a spray that is diagonally tilted with respect to valve longitudinal axis 8. In this context, in one possible variant, there should be produced, e.g., a swirl-impacted hollow-cone spray that is as rotationally symmetrical as possible and that has an equal distribution across the hollow-cone periphery. In the known swirl disks or swirl attachments, a spray-discharge of this type is only possible using diagonally running outlet holes in downstream spray-discharge components.

One essential point of the present invention lies in having devised geometries for swirl disk 30, using which the above-mentioned goal can be attained very easily. In this context, it should be noted that swirl disk 30 manufactured using multilayer electroplating, due to the manufacturing technology, has only vertical walls, on the basis of which, when the walls are viewed in isolation, no diagonal spray-discharge seems possible. In an advantageous manner, however, on the basis of the vertical walls in swirl disk 30, a diagonal spray-discharge is assured due to the asymmetry in the conturing in at least one of the layers of swirl disk 30, and, in addition, it is advantageous that there is no need for downstream, precision-manufactured components into which, of course, a diagonally running spray-discharge hole could be introduced without difficulty. For increasing the effect already obtained using swirl disk 30, or for supporting or simply mounting swirl disk 30, of course, downstream components such as spray-discharge perforated disks are conceivable (see FIG. 12).

Figure 9:
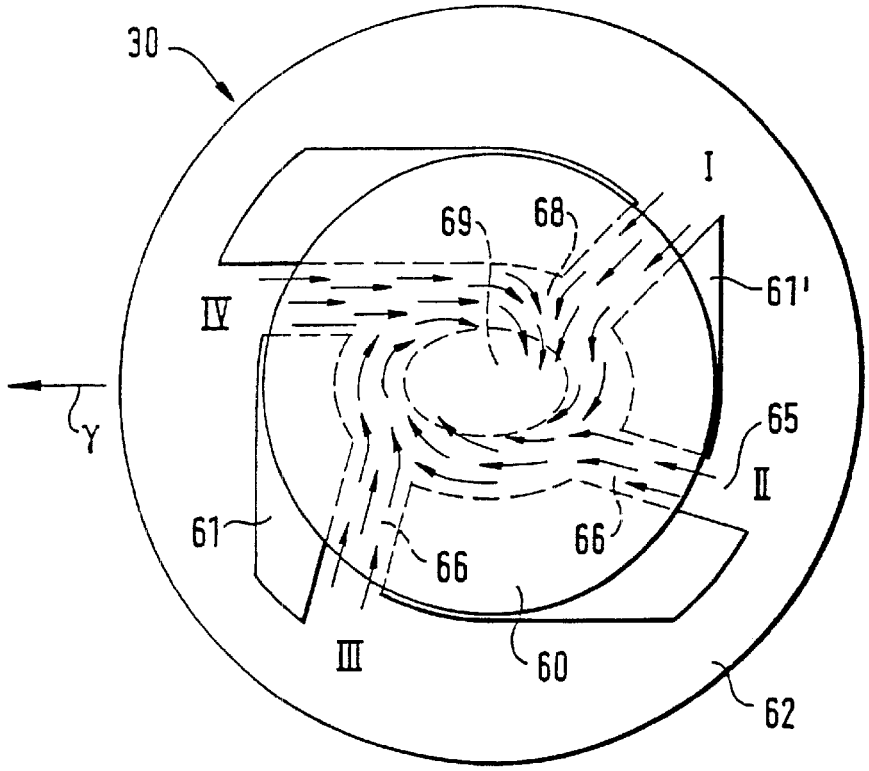
FIG. 9 shows a top view of a sixth exemplary embodiment of the multilayer electroplated swirl disk.

In FIG. 9, a swirl disk 30 of the present invention is depicted using which, despite the vertical walls of all orifice areas a spray can be produced that runs diagonally tilted with respect to the axis of symmetry of swirl disk 30, and, e.g., has an equal distribution across the periphery of the hollow cone. In the central swirl-producing layer 61, provision is made for four material areas 61', which all have contours different from each other. Between material areas 61', four swirl channels 66 are configured, which, due to the contour differences of material areas 61', are distinguished by a different orientation in each case with regard to swirl chamber 68, and, therefore, are designated as I through IV. Four swirl channels 66, in their orientation in the liquid to be spray-discharged, produce varying ratios between swirl speed and radial speed components. In the exemplary embodiment depicted, the radial speed component steadily decreases from swirl channel 66-I through swirl channel 66-IV, whereas the swirl speed component steadily increases from swirl channel 66-I through swirl channel 66-IV. In an advantageous manner, outlet orifice 69 in this example is configured to be elliptical and as short as possible in the axial direction. Whereas first swirl chamber 66-1 is essentially aligned with the center of elliptical outlet orifice 69, this radial orientation, in the example according to FIG. 9, decreases in a clockwise direction, to fourth swirl channel 66-IV, which is aligned so as to pass outlet orifice 69 tangentially. In the exemplary embodiment depicted in FIG. 9, a spray to be discharged in one spray-discharge direction would exit into the drawing plane diagonally tilted to the left between swirl channels 66-III and 66-IV. This stream orientation is indicated by an arrow and $\gamma$, $\gamma$ indicating an angle of the spray with respect to the axis of symmetry of swirl disk 30.

It should be mentioned that a rotationally-symmetrical hollow-cone spray having an equal distribution across the hollow-cone periphery only represents one spray shape, described here in greater detail, for the diagonal spray-discharge, but that the other spray shapes already discussed in the introduction to the description, i.e., also those that have an unequal distributions and skeins, can also be generated by the corresponding asymmetrical conturing in swirl disk 30.

Figure 10:
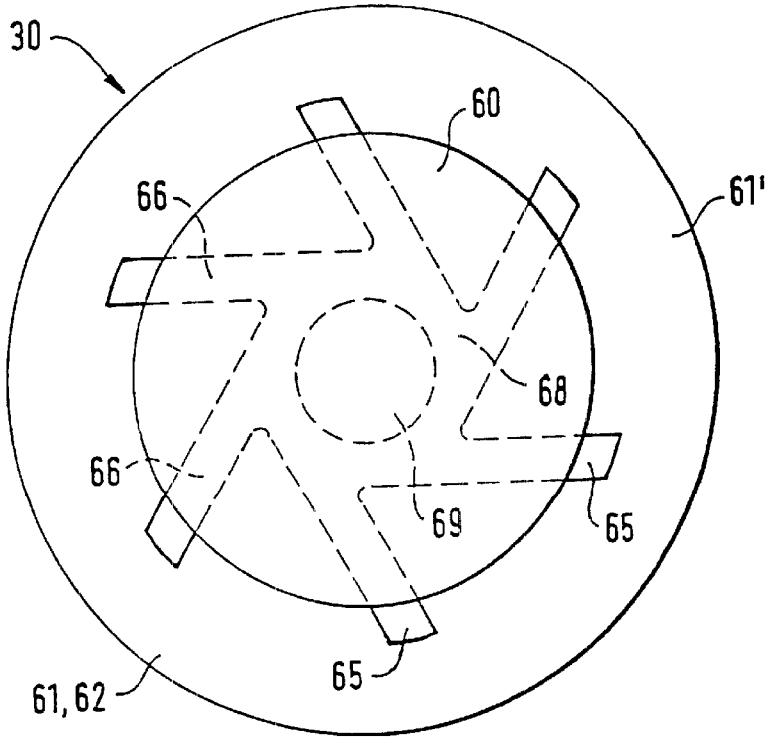
FIG. 10 shows a top view of a seventh exemplary embodiment of the multilayer electroplated swirl disk.

A swirl disk 30 having further particular features, not contained in any further exemplary embodiment, is shown in FIG. 10. A first particular feature lies in the fact that both lower layers 61 and 62 have the same external diameter, central swirl-producing layer 61 including only one single, connected material area 61'. Therefore, swirl channels 66 emptying largely tangentially into swirl chamber 68 are not connected at their intake areas 65 facing away from swirl chamber 68 to the external periphery of swirl disk 30. Rather, between intake areas 65 of swirl channels 66 and the external periphery of swirl disk 30, there remains a circumferential edge area of material area 61'. The circumferential edge is used to squeeze swirl disk 30, for mounting purposes, at its periphery in a particularly easy manner. Apart from the examples already described of swirl disk 30 having two or four swirl channels 66, on the basis of FIG. 10 it should be made clear that using multilayer electroplating it is possible to produce a different number of swirl channels 66 (e.g., six).

Apart from a configuration of intake areas 65 having an essentially rectangular or quadratic contour, it can also be advantageous to configure swirl channels 66 as having intake areas 65 that are bent so as to be hook shaped (not depicted). The fuel flowing into intake areas 65 can enter swirl channels 66 with little turbulence, as a result of which it is possible to produce a swirl that is essentially without disturbance. It is of particular advantage if the inlet cross-section, lying in the plane of the drawing, of intake areas 65, the inlet cross-section being significantly determined by the coverage (overlapping) of cover layer 60, is smaller than the swirl channel cross-section, which lies perpendicular to the plane of the drawing and is determined by the height and width of swirl channel 66. Intake areas 65 are thus a pre-choke as well as the flow-determining cross-section of swirl disk 30.

Figure 11:
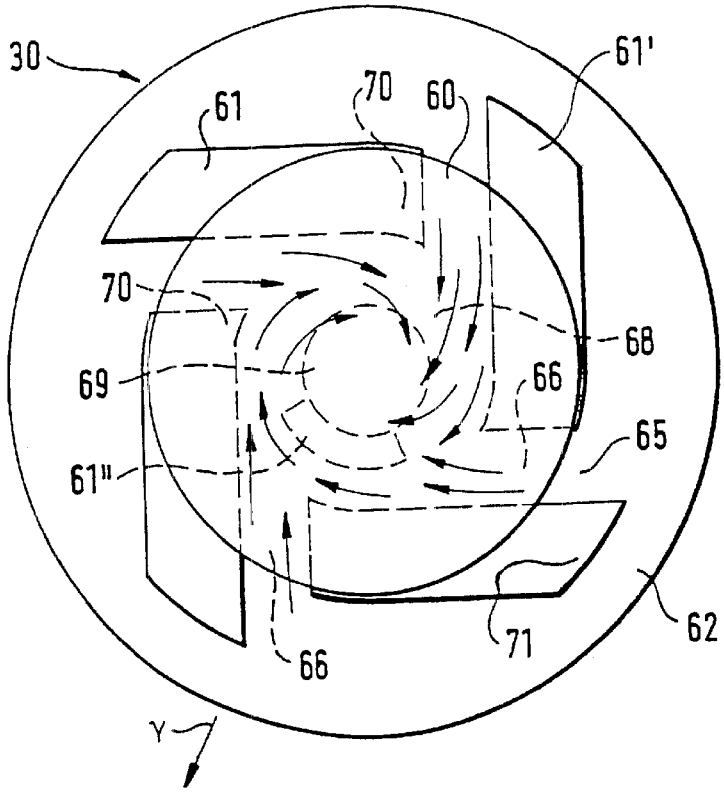
FIG. 11 shows a top view of an eighth exemplary embodiment of the multilayer electroplated swirl disk.

In FIG. 11, one of the innumerable possible exemplary embodiments of a swirl disk 30 that can be manufactured using multilayer electroplating is depicted, which, in addition to material areas 61' for the formation of swirl channels 66 and for establishing the contour and size of swirl chamber 68, has further material areas 61" within swirl chamber 68 in swirl-producing layer 61. These additional material areas 61" can be arranged as desired so that a spray is spray-discharged that is tilted diagonally with respect to the axis of symmetry of swirl disk 30, and specifically, in the example shown in FIG. 11, in the direction indicated by the arrow and γ. A diagonal spray-discharge of this type is achieved by placing in swirl chamber 68 material areas 61" that have one or more crescent- or arc-shaped (FIG. 11) or undepicted rectangular, triangular, square, or similar contours. In the example depicted, curved material area 61" forms a flow barrier with respect to outlet orifice 69, so that the liquid can enter outlet orifice 69 particularly forcefully and swirl-impacted from the side opposite the flow barrier, and for this reason the diagonal spray-discharge is aligned (arrow y) with respect to material area 61". Using multilayer electroplating, any contour of material areas 61" in swirl chamber 68 can be produced.

Figure 12:
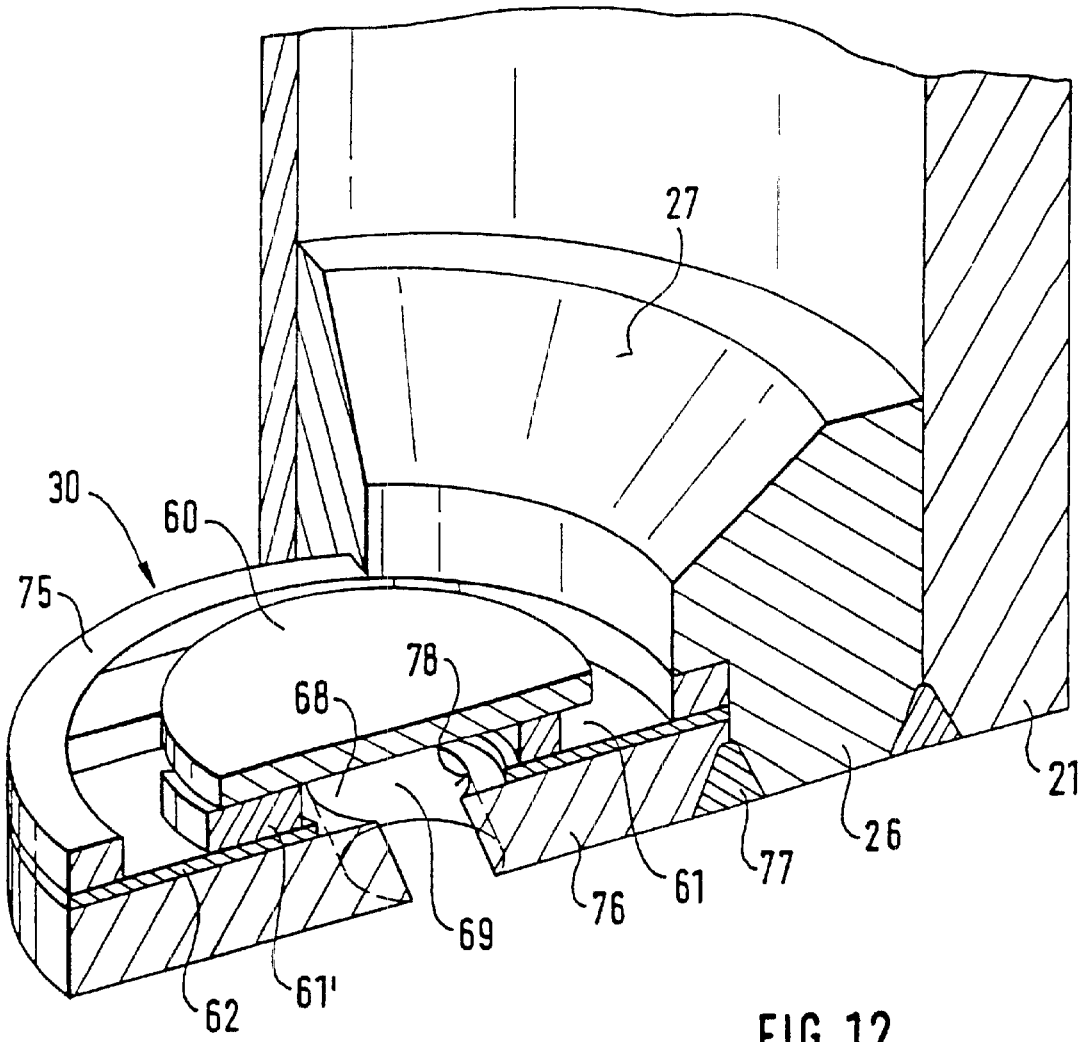
FIG. 12 shows a top view of a ninth exemplary embodiment of the multilayer electroplated swirl disk.

FIG. 12 shows an exemplary embodiment for a particular selection of material for individual layers 60, 61, and 62 of swirl disk 30. Using multilayer electroplating, it is possible without difficulty to deposit various metals (Ni, NiCo, NiFe, NiW, Cu) on top of each other, only one metal being deposited, however, within one electroplating step. Due to this flexibility in the choice of material, it is possible to realize an advantageous sealing of swirl disk 30 in installation in a spray-discharge device, in particular in a fuel injection valve. Whereas cover layer 60 and base layer 62 are made of a harder electroplating material (e.g., NiCo), central swirl-producing layer 61 is deposited using a softer electroplating material (e.g. Ni). In the manufacturing process, from electroplating layer to electroplating layer only the electroplating basin (reservoir) is changed from NiCo to Ni, and vice versa. Both layers 60 and 62 provide swirl disk 30 with greater stability due to the greater tensile strength of NiCo, stability being necessary due to the high pressure loads, e.g. in high-pressure injection valves. Apart from already-mentioned material areas 61', swirl-producing layer 61 has a further external annular material area 75, for forming swirl channels 66.

Material area 75 runs uninterruptedly around the periphery of swirl disk 30 and functions in this context as a sealing element. Since upper cover layer 60 has a smaller diameter than lower layers 61 and 62, external material area 75 lies uncovered from the top. Swirl disk 30 makes sealing contact, in a recess of valve seat element 26, with this material area 75, as is illustrated in FIG. 12. The soft material (Ni) of area 75 makes possible a large compression path at relatively low mechanical stresses within material area 75. The compression path makes possible the positive-fit contacting of the upper sealing surface of material area 75 with the surface of hard valve seat element 26, as a result of which the sealing function is assured. In an advantageous manner, if a configuration of this type is used, there is no need for separate sealing elements. A sufficient, remaining contact pressure of material area 75 on valve seat element 26 is achieved, e.g., by arranging downstream of swirl disk 30 a spray-discharge perforated disk 76, which, for example, is fixedly joined to valve seat element 26 by a welded seal 77, and which supports swirl disk 30. Spray-discharge perforated disk 76 has, e.g., a spray-discharge orifice 78 that is tilted diagonally with respect to valve longitudinal axis 8, in order to realize the diagonal spray-discharge which has been mentioned more than once. In principle, it is conceivable to design a plurality of swirl disks 30 as a sandwich packet.

What is claimed is:

1. A swirl disk composed of at least one metallic material, and including at least one intake area and at least one complete passage for a liquid, the swirl disk comprising:

a lower base layer including at least one outlet orifice;

a central swirl-producing layer which includes a swirl chamber;

at least two swirl channels which open into the swirl chamber; and an upper closed cover layer situated above the swirl chamber and having a cross-sectional surface, the cross-sectional surface entirely lacking orifice contours, wherein the upper closed cover layer completely covers the swirl chamber, and wherein the lower base layer, the central swirl-producing layer and the upper closed cover layer are built up directly on top of one another using an electroplating metal deposition procedure to obtain a predetermined adhesive strength.

2. The swirl disk according to claim 1, wherein the central swirl-producing layer is formed from a plurality of material areas which are distanced from one another in a circumferential direction, and wherein the swirl chamber includes first contours, and the swirl channels include second contours, the first and second contours being defined using a geometric position of each of the first and second contours with respect to one another.

3. The swirl disk according to claim 2, wherein the material areas include four material areas, and wherein the swirl chamber and four of the swirl channels are provided between the four material areas.

4. The swirl disk according to claim 3, wherein the material areas are arranged at the swirl chamber which has one of a circular shape, an elliptical shape, a polygonal shape and a mixture of circular, elliptical and polygonal shapes.

5. The swirl disk according to claim 2, wherein the material areas extend toward an interior portion of the lower base layer from an external portion of the lower base layer to reach the swirl chamber.

6. The swirl disk according to claim 5, wherein the material areas have a shape of a spiral.

7. The swirl disk according to claim 6, wherein the swirl channels are enclosed between the material areas, and wherein the swirl channels have a narrowing cross-section in a flow direction.

8. The swirl disk according to claim 2, wherein the material areas extend at a predetermined distance from an external periphery of the lower base layer, the external periphery substantially defining an external diameter of the swirl disk.

9. The swirl disk according to claim 8, wherein the material areas have a shape of a bar.

10. The swirl disk according to claim 8, wherein the material areas have ends which are rounded off to have a shape of a shovel, the ends facing the swirl chamber.

11. The swirl disk according to claim 2, wherein the material areas are shaped to diverge from one another, and wherein each of the swirl channels has a different orientation with respect to an axis of symmetry of the swirl disk.

12. The swirl disk according to claim 11, wherein each of the swirl channels has a periphery which extends so that respective radial and tangential swirl orientations of the swirl channels continually change in opposing directions.

13. The swirl disk according to claim 1, wherein the central swirl-producing layer is formed by a single contiguous material area, the single contiguous material area defining first contours of the swirl chamber and second contours of the swirl channels based on a geometry of the single contiguous material.

14. The swirl disk according to claim 13, wherein the material area and the lower base layer have equal external diameters.

15. The swirl disk according to claim 13, wherein the swirl channels have ends which face away from the swirl chamber, the ends having intake areas which are separated from an external periphery of the swirl disk by a circumferential edge area of the material area.

16. The swirl disk according to claim 15, wherein the intake area is a free and uncovered area which has a horizontal inlet cross-section, the horizontal inlet cross-section being smaller than a smallest vertical channel cross-section of each of the swirl channels.

17. The swirl disk according to claim 1, wherein the swirl chamber includes material areas to influence a flow of the fluid.

18. The swirl disk according to claim 1, wherein the lower base layer, the central swirl-producing layer and the upper closed cover layer are built up using at least two different materials.

19. The swirl disk according to claim 18, wherein the upper closed cover layer and the lower base layer are composed of a first electroplating material which is harder than a second electroplating material of the swirl-producing layer, the swirl-producing layer being located between the upper closed cover layer and the lower base layer.

20. The swirl disk according to claim 1, wherein the at least one outlet orifice in the lower base layer has one of a circular shape, an elliptical shape, a polygonal shape and a mixture of circular, elliptical and polygonal shapes.

21. The swirl disk according to claim 1, wherein the at least one outlet orifice in the lower base layer is provided at one of a centered position and an off-center position with respect to an axis of symmetry of the swirl disk.

22. The swirl disk according to claim 1, wherein the upper closed cover layer has an external diameter which is smaller than an external diameter of the lower base layer.

23. The swirl disk according to claim 1, wherein the swirl disk is provided for an injection valve.

24. The swirl disk according to claim 1, wherein the electroplating metal deposition procedure includes a multilayer electroplating procedure.

25. A fuel injection valve for a fuel injection system of an internal combustion engine and having a valve longitudinal axis, the fuel injection valve comprising:

a valve seat element;

a stationary valve seat situated on the valve seat element;

an actuator including a movable valve part which cooperates with the stationary valve seat for opening and closing the fuel injection valve; and a swirl disk situated downstream of the valve seat and having a multilayer structure, the swirl disk being composed of at least one metallic material, the swirl disk including:

at least one intake area, a lower base layer, at least one outlet orifice situated in the lower base layer, a swirl chamber, at least two swirl channels opening into the swirl chamber upstream of the at least one outlet orifice, and an upper closed cover layer situated above the swirl chamber and having a cross-sectional surface, the cross-sectional surface entirely lacking orifice contours, wherein the upper closed cover layer completely covers the swirl chamber, and wherein the lower base layer and the upper closed cover layer are built up directly on top of one another using an electroplating metal deposition procedure to obtain a predetermined adhesive strength.

26. The fuel injection valve according to claim 25, wherein the central swirl-producing layer is formed from a plurality of material areas which are distanced from one another in a circumferential direction, and wherein the swirl chamber includes first contours, and the swirl channels include second contours, the first and second contours being defined using a geometric position of each of the first and second contours with respect to one another.

27. The fuel injection valve according to claim 26, wherein the material areas include four material areas, and wherein the swirl chamber and four of the swirl channels are provided between the four material areas.

28. The fuel injection valve according to claim 27, wherein the material areas are arranged at the swirl chamber which has one of a circular shape, an elliptical shape, a polygonal shape and a mixture of circular, elliptical and polygonal shapes.

29. The fuel injection valve according to claim 26, wherein the material areas extend toward an interior portion of the lower base layer from an external portion of the lower base layer to reach the swirl chamber.

30. The fuel injection valve according to claim 29, wherein the material areas have a shape of a spiral.

31. The fuel injection valve according to claim 30, wherein the swirl channels are enclosed between the material areas, and wherein the swirl channels have a narrowing cross-section in a flow direction.

32. The fuel injection valve according to claim 26, wherein the material areas extend at a predetermined distance from an external periphery of the lower base layer, the external periphery substantially defining an external diameter of the swirl disk.

33. The fuel injection valve according to claim 32, wherein the material areas have a shape of a bar.

34. The fuel injection valve according to claim 32, wherein the material areas have ends which are rounded off to have a shape of a shovel, the ends facing the swirl chamber.

35. The fuel injection valve according to claim 26, wherein the material areas are shaped to diverge from one another, and wherein each of the swirl channels has a different orientation with respect to an axis of symmetry of the swirl disk.

36. The fuel injection valve according to claim 35, wherein each of the swirl channels has a periphery which extends so that respective radial and tangential swirl orientations of the swirl channels continually change in opposing directions.

37. The fuel injection valve according to claim 25, wherein the central swirl-producing layer is formed by a single contiguous material area, the single contiguous material area defining first contours of the swirl chamber and second contours of the swirl channels based on a geometry of the single contiguous material.

38. The fuel injection valve according to claim 37, wherein the material area and the lower base layer have equal external diameters.

39. The fuel injection valve according to claim 37, wherein the swirl channels have ends which face away from the swirl chamber, the ends having intake areas which are separated from an external periphery of the swirl disk by a circumferential edge area of the material area.

40. The fuel injection valve according to claim 39, wherein the intake area is a free and uncovered area which has a horizontal inlet cross-section, the horizontal inlet cross-section being smaller than a smallest vertical channel cross-section of each of the swirl channels.

41. The fuel injection valve according to claim 25, wherein the swirl chamber includes material areas to influence a flow of a fluid.

42. The fuel injection valve according to claim 25, wherein the swirl disk includes a central swirl-producing layer, and wherein the lower base layer, the central swirl-producing layer and the upper closed cover layer are built up using at least two different materials.

43. The fuel injection valve according to claim 42, wherein the upper closed cover layer and the lower base layer are composed of a first electroplating material which is harder than a second electroplating material of the swirl-producing layer, the swirl-producing layer being located between the upper closed cover layer and the lower base layer.

44. The fuel injection valve according to claim 25, wherein the at least one outlet orifice in the lower base layer has one of a circular shape, an elliptical shape, a polygonal shape and a mixture of circular, elliptical and polygonal shapes.

45. The fuel injection valve according to claim 25, wherein the at least one outlet orifice in the lower base layer is provided at one of a centered position and an off-center position with respect to an axis of symmetry of the swirl disk.

46. The fuel injection valve according to claim 25, wherein the upper closed cover layer has an external diameter which is smaller than an external diameter of the lower base layer.

47. The fuel injection valve according to claim 25, wherein the swirl disk has at least one material area for providing a sealant with respect to the valve seat element.

48. The fuel injection valve according to claim 25, further comprising:

a retaining element arranged downstream of the valve seat element, wherein the swirl disk is mounted in the fuel injection valve by one of a welding procedure, a procedure for providing an adhesive and a compression-type jamming procedure in the retaining element.

49. The fuel injection valve according to claim 48, wherein the retaining element includes a spray-discharge perforated disk.

50. The fuel injection valve according to claim 25, wherein the swirl disk is mounted in a valve seat support using one of a welding procedure, an adhesive-applying procedure and a compression-type jamming procedure.

51. The fuel injection valve according to claim 25, wherein the swirl disk includes a plurality of swirl disks which are built up on one another in a form of a sandwich packet.

52. The fuel injection valve according to claim 25, wherein the fuel injection valve is provided for a direct injection of fuel into an combustion chamber of the internal combustion engine.

53. The fuel injection valve according to claim 25, wherein the swirl disk is provided for an injection valve.

54. The fuel injection valve according to claim 25, wherein the electroplating metal deposition procedure includes a multilayer electroplating procedure.

* * * * *